United States Patent [19]

Gallusser et al.

[11] 4,359,254

[45] Nov. 16, 1982

[54] ELECTRICAL CONNECTOR COUPLING RING HAVING AN INTEGRAL SPRING

[75] Inventors: David O. Gallusser, Oneonta; Valentine J. Hemmer, Sidney; Gary C. Toombs, Oneonta, all of N.Y.

[73] Assignee: The Bendix Corporation, Southfield, Mich.

[21] Appl. No.: 206,770

[22] Filed: Nov. 14, 1980

[51] Int. Cl.[3] ..... H01R 13/639

[52] U.S. Cl. ..... 339/89 M; 339/DIG. 2

[58] Field of Search ..... 339/DIG. 2, 89 R, 89 C, 339/89 M, 90 R, 90 C; 285/82, 86, 89, 92

[56] References Cited

U.S. PATENT DOCUMENTS

| | | | |
|---|---|---|---|
| 2,728,895 | 12/1955 | Quackenbush et al. | 339/89 |
| 3,805,379 | 4/1974 | Vetter | 29/629 |
| 3,917,373 | 11/1975 | Peterson | 339/89 R |
| 4,030,798 | 6/1977 | Paoli | 339/89 R |
| 4,074,927 | 2/1978 | Ball | 339/89 M |
| 4,168,105 | 9/1979 | Herrmann, Jr. | 339/89 M |

*Primary Examiner*—John McQuade

*Attorney, Agent, or Firm*—Raymond J. Eifler

[57] ABSTRACT

The invention is an electrical connector assembly characterized by a plurality of resiliently deflectable fingers (11) which extend between a shoulder 12 in the coupling ring and a shoulder 22 of the housing 20 to provide a bias between the coupling ring 10 and the housing 20 when the coupling ring 10 is completely threaded onto another connector housing. The fingers 11 may be integrally molded into either the coupling ring or the housing shoulder eliminating the need for an extra biasing member. The bias increases the force of friction on the threads in the coupling ring when it is fully mated to retard unwanted rotation, i.e., uncoupling.

8 Claims, 13 Drawing Figures

FIG. 8
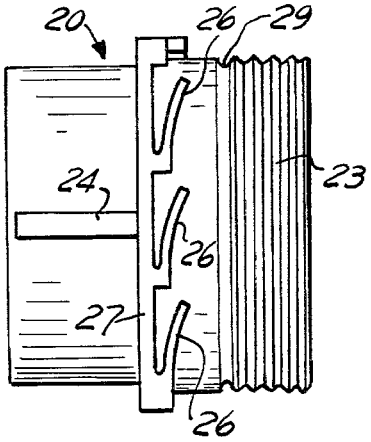
FIG. 9
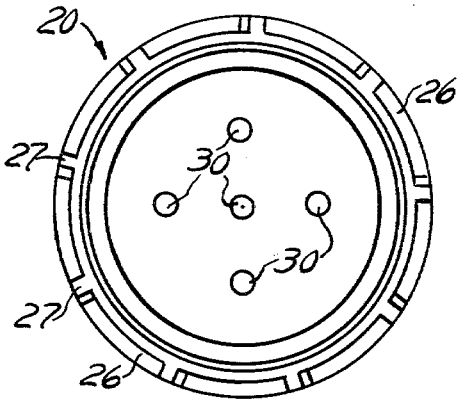
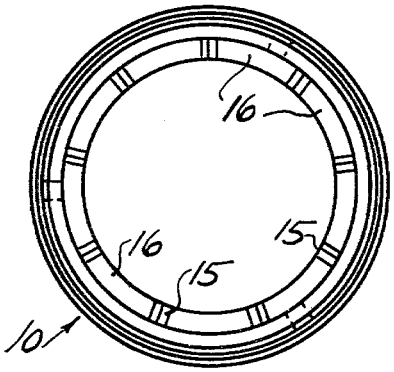
FIG. 11
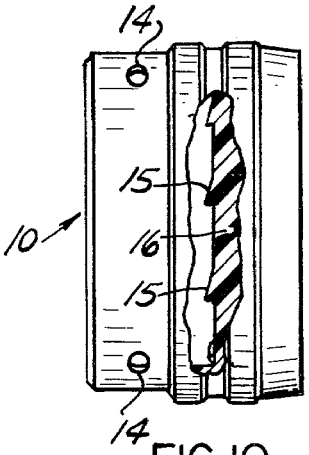
FIG. 10
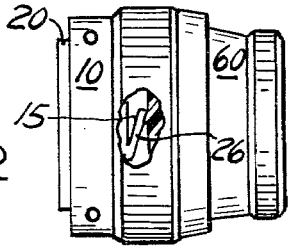
FIG. 12
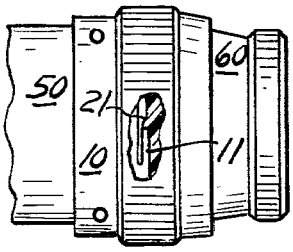
FIG. 13

ELECTRICAL CONNECTOR COUPLING RING HAVING AN INTEGRAL SPRING

This invention relates to a coupling ring for an electrical connector assembly.

An electrical connector assembly is generally comprised of two separate housings, each having contacts mateable with contacts in the other when the housings are connected together by a coupling member. A coupling member is generally mounted to one of the housings by one or more snap rings to captivate a flange of the coupling ring against the shoulder of the housing. One type of coupling ring includes threads at the forward end, which thread onto the other housing to connect the housings together. To prevent unwanted decoupling of the connector assembly, the coupling member is usually biased in one direction (generally rearwardly), to increase the frictional force on the threads when a coupling member is completely threaded onto the other housing. Generally a wave washer is part of the mounting assembly for the coupling ring to provide the necessary spring action against the coupling ring and hence the threads of the coupling ring and the other housing to which it is connected. Examples of such a connector assembly may be found in U.S. Pat. No. 4,074,927, issued Feb. 21, 1978 and entitled "Electrical Connector With Insert Member Retaining Means"; and U.S. Pat. No. 3,805,379, issued Apr. 23, 1974 and entitled "Method of Assembling An Electrical Connector to Effect A Preloading Thereof". A disadvantage to this approach is that separate members i.e. one or more spring washers, are extra parts necessary to mount the coupling ring to the connector housing. Further the washers are generally comprised of metal and therefore add extra weight to the connector as well as being subject to corrosion.

DISCLOSURE OF THE INVENTION

The invention eliminates the need in an electrical connector for extra pieces in the coupling member mounting mechanism.

The invention is an electrical connector characterized by a plurality of resiliently deflectable fingers which extend between the coupling ring and the housing to provide a bias between the two members when the coupling ring is completely threaded onto another connector housing.

One advantage of the invention is that it provides a newer approach to providing the bias between a coupling nut and the housing to which it connects.

Another advantage is that the integral plastic fingers add less weight to the connector assembly and are corrosion resistant.

Another advantage of the invention is that the fingers which are integral with the coupling nut or housing, eliminates the need for an additional member, such as a spring washer.

Another advantage of the invention is that it reduces the time required to assemble the coupling member to the housing because of the elimination of the separate spring washer.

Another advantage of the invention is that the integral fingers increases the frictional force of the coupling nut threads on the threads of the other housing to minimize the chance of unwanted decoupling of the coupling nut from the other housing.

Another advantage of the invention is that the fingers may be used in combination with anti-decoupling ramps on the housing to prevent accidental rotation of the coupling ring.

DETAILED DESCRIPTION OF THE INVENTION

FIG. 8 illustrates a housing which embodies the features of this invention.

FIG. 9 is a rear view of the housing shown in FIG. 8.

FIG. 10 illustrates a coupling ring embodying secondary features of the invention.

FIG. 11 illustrates a front view of the coupling ring shown in FIG. 10.

FIG. 12 shows a view of the coupling ring of FIG. 10 mounted to the housing shown in FIG. 8.

FIG. 13 illustrates a coupling ring in its fully mated position.

Figure 1:
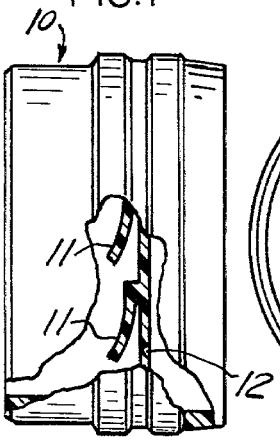
FIG. 1 illustrates a coupling ring incorporating the principles of the invention.

Referring now to the drawings, FIG. 1 illustrates a coupling ring 10 which has an internal annular shoulder 12 which includes a plurality of resiliently deflectable fingers 11. The coupling ring is preferrably comprised of a one piece molded plastic material such as Torlon.

Figure 2:
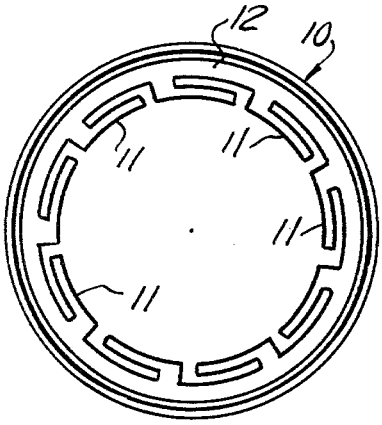
FIG. 2 is a front view of the coupling ring shown in FIG. 1.

FIG. 2 illustrates a front view of the coupling ring shown in FIG. 10 and illustrates how the fingers 11 project from the annular shoulder 12.

Figure 3:
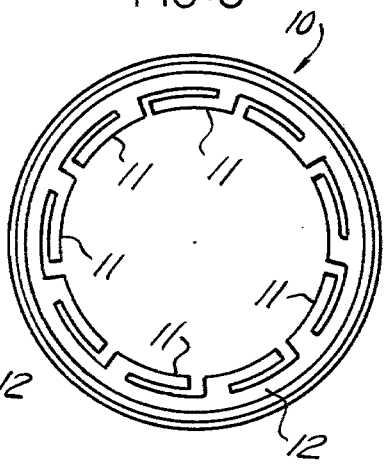
FIG. 3 is a rear view of the coupling ring shown in FIG. 1.

FIG. 3 illustrates a rear view of the coupling ring 10 shown in FIG. 1 and illustrates how the fingers 11 are seen extending from the annular shoulder 12.

Figure 4:
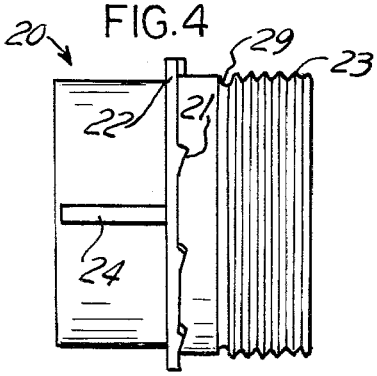
FIG. 4 illustrates a housing which includes secondary feature of the invention which retards rotation of the coupling ring shown in FIG. 1.

FIG. 4 illustrates a connector housing 20 having a rear portion that includes threads 23; a forward portion that includes a key 24; an annular external shoulder 22 that includes a plurality of ramps 21; and a groove 29 for receiving a snap ring to retain a coupling ring.

Figure 5:
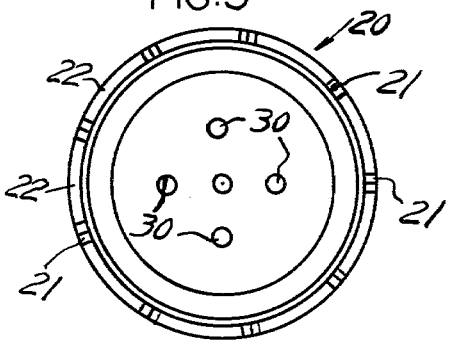
FIG. 5 is a front view of the connector housing shown in FIG. 4.

FIG. 5 illustrates the front view of the housing shown in FIG. 4. The housing 20 includes a plurality of electrical contacts 30 mounted therein and adapted to mate with electrical contacts of another connector housing (not shown). The plurality of ramps 21 are located at intervals along the annual external shoulder 22 of the housing 20.

Figure 6:
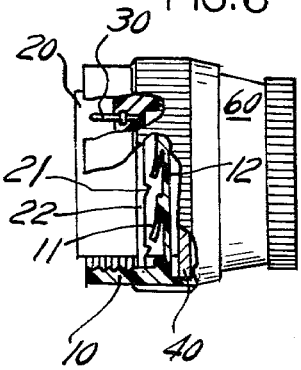
FIG. 6 shows the coupling ring shown in FIG. 1 mounted on a housing shown in FIG. 4.

FIG. 6 illustrates how the coupling ring 10 is rotatably mounted to the housing 20. This is generally accomplished by captivating annular shoulder 12 between a snap ring 40 and the shoulder 22 of the housing. As the coupling nut 10 is threaded onto a housing (not shown) the fingers 11 will travel across the projection 21 until the fingers 11 are pressed against the coupling ring shoulder 12 and the housing shoulder 22. A nut 60 is shown mounted to the rear of the housing 20. The cutaway portion shows one of the contacts 30 mounted in the housing 20.

Figure 7:
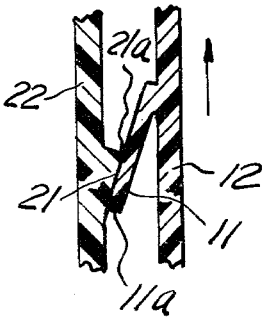
FIG. 7 is an enlarged view of a portion of the coupling ring and the housing shown in FIG. 6.

FIG. 7 illustrates an enlarged view of the deflectable fingers 11 of the coupling ring and the projections 21 on the shoulder 22 of the connector housing. The projections 21 on the housing are angled such that in one direction the fingers 11 slide freely across the projections but, in an opposite direction engage a face 21*a*, which retards but does not prevent rotation in the opposite direction. This engagement of a free end 11*a* of the deflectable finger 11 and the one face 21*a* of the projection 21 provides an anti-decoupling feature when the coupling nut has been coupled to and completely threaded onto another housing of an electrical connector assembly.

FIG. 8 illustrates another embodiment of the invention wherein the deflectable fingers that provide the biasing between a coupling nut (not shown) and a housing 20 are a plurality of fingers 26 integral with an external shoulder 27 on the housing 20. The front portion of the housing 20 includes a key 24 for aligning this housing with another housing (not shown); and the rear portion includes a plurality of threads for connecting other parts to the housing 20 and a groove 29 for receiving a snap ring which retains a coupling ring.

FIG. 9 is a rearview of the housing shown in FIG. 8 and illustrates a plurality of contacts 30 mounted within the housing 20; and the location of each of the deflectable fingers 26 around the outside and rear face of the shoulder 27.

FIG. 10 illustrates a coupling nut having an internal shoulder 16 that includes a plurality of projections 15 for providing an anti-decoupling feature with the housing shown in FIG. 8. In this embodiment the coupling ring 10 includes a plurality of apertures 14 for visually inspecting the engagement of the internal threads on the coupling ring 10 with the threads on the other half of a connector housing (not shown).

FIG. 11 illustrates a front view of the coupling ring shown in FIG. 10 and illustrates how the plurality of projections 15 are located around the annular shoulders 16 on the inside of the coupling nut 10.

FIG. 12 illustrates the coupling ring shown in FIG. 10 mounted to the housing shown in FIG. 8. A cutaway view shows the inner action between the resilient fingers 26 on the housing 20 and the projections 15 of the coupling ring.

FIG. 13 illustrates the connector assembly shown in FIG. 12 in its fully mated position with another housing 50. This illustrates how the fingers 26 have been completely deflected against the housing shoulder 27 to provide a rearward bias against the coupling ring 10 which in turn provides increased frictional force between the threads on the coupling ring 10 and the threads on the other housing 50. In addition to this additional frictional force to help prevent unwanted decoupling, the ends of the fingers 26 engage the shoulders of projections 15 which are shaped to retard, but not prevent, rotation in a direction which will allow the coupling ring to be decoupled from the housing.

While a preferred embodiment of the invention has been disclosed, it will be apparent to those skilled in the art, that changes may be made to the invention as set forth in the appended claims, and in some instances, certain features of the invention may be used to advantage without corresponding use of other features. For example, the fingers may be integral with either the connector housing or the coupling ring and the remaining piece may or may not have projections on it to inhibit rotation in a particular direction after the coupling nut has been fully seated on another connector housing. Accordingly, it is intended that the illustrative and descriptive materials herein be used to illustrate the principles of the invention and not to limit the scope thereof.

Having described the invention, what is claimed is:

1. In combination with an electrical connector of the type having: a cylindrical housing having a central axis, a forward portion, a central portion, a rear portion, an annular groove and an annular shoulder in said central portion; a plurality of electrical contacts mounted in said housing, each of said contacts having a forwardly facing mating portion; a plastic coupling ring telescoped over a portion of said housing, said coupling ring having a rear portion and a forward portion adapted to connect to a similar housing having contacts that are adapted to mate with the contacts in said housing, and means for rotatably mounting said coupling ring to said housing between said annular groove and shoulder in said housing, the improvement comprising:

means for biasing said coupling ring in the rearward direction, said biasing means including a plurality of resiliently deflectable fingers, integral with said coupling ring and extending forwardly from the rear portion of said coupling ring at an angle with a plane perpendicular to the central axis of said housing.

2. The electrical connector as recited in claim 1 including at least one rearwardly extending projection on the rear face of the housing shoulder, said projection having a first surface adapted to engage at least a portion of the front end of one of said fingers only when said coupling nut is rotated in one of the two directions of rotation.

3. In combination with an electrical connector of the type having: a cylindrical housing comprised of plastic and having a central axis, a forward portion, a central portion, a rear portion, an annular groove and an annular shoulder in said central portion; a plurality of electrical contacts mounted in said housing, each of said contacts having a forwardly facing mating portion; a plastic coupling ring telescoped over a portion of said housing, said coupling ring having a rear portion and a forward portion adapted to connect to a similar housing having contacts that are adapted to mate with the contacts in said housing, the rear portion of said coupling ring having an inwardly extending annular flange having a forwardly facing shoulder and a rearwardly facing shoulder; and means for rotatably mounting said coupling ring to said housing between said annular groove and shoulder in said housing, the improvement comprising:

means for biasing said coupling ring in the rearward direction, said biasing means including at least one resiliently deflectable projection, integral with the shoulder in said housing and extending rearwardly from the rearwardly facing shoulder of said housing.

4. The electrical connector as recited in claim 3 wherein the biasing means comprises a plurality of resiliently deflectable fingers integral with the shoulder in said housing.

5. The electrical connector as recited in claim 4 including at least one forward projection on the forward face of the coupling ring flange, said projection having a first surface adapted to engage at least a portion of the front end of one of said fingers when said coupling ring is rotated in only one of the two directions of rotation.

6. The electrical connector as recited in claim 3 including at least one forward projection on the forward face of the coupling ring flange, said projection having a first surface adapted to engage at least a portion of the front end of one of said projections when said coupling ring is rotated in only one of the two directions of rotation.

7. A coupling member for use with an electrical connector, said coupling member comprising:

a plastic sleeve having a rear portion and a forward portion;

means in the forward portion of said coupling member for connecting said sleeve to an electrical connector housing;

an annular flange extending inwardly from the rear portion of said sleeve, said flange having a forwardly facing shoulder and a rearwardly facing shoulder; and at least one resiliently deflectable finger integral with the flange of said sleeve and extending at an angle from the forwardly facing shoulder of said flange.

8. A coupling member for use with an electrical connector, said coupling member comprising:

a plastic sleeve having a rear portion and a forward portion;

means in the forward portion of said coupling member for connecting said sleeve to an electrical connector housing;

an annular flange extending inwardly from the rear portion of said sleeve, said flange having a forwardly facing shoulder and a rearwardly facing shoulder; and at least one resiliently deflectable projection integral with the flange of said sleeve and extending forwardly from the forwardly facing shoulder of said flange.

* * * * *